US008687832B2

(12) United States Patent
Elmedyb et al.

(10) Patent No.: US 8,687,832 B2
(45) Date of Patent: Apr. 1, 2014

(54) HEARING AID SYSTEM WITH FEEDBACK ARRANGEMENT TO PREDICT AND CANCEL ACOUSTIC FEEDBACK, METHOD AND USE

(75) Inventors: Thomas Bo Elmedyb, Smørum (DK); Johan Hellgren, Linköping (SE)

(73) Assignee: Oticon A/S, Smorum (DK)

( * ) Notice: Subject to any disclaimer, the term of this patent is extended or adjusted under 35 U.S.C. 154(b) by 865 days.

(21) Appl. No.: 12/681,197

(22) PCT Filed: Sep. 30, 2008

(86) PCT No.: PCT/EP2008/063065
§ 371 (c)(1),
(2), (4) Date: Apr. 1, 2010

(87) PCT Pub. No.: WO2009/043842
PCT Pub. Date: Apr. 9, 2009

(65) Prior Publication Data

US 2010/0254555 A1 Oct. 7, 2010

(30) Foreign Application Priority Data

Oct. 3, 2007 (EP) ..... 07117805

(51) Int. Cl.
*H04R 25/00* (2006.01)

(52) U.S. Cl.
USPC ..... 381/318; 381/312; 381/320; 381/71.11

(58) Field of Classification Search
USPC ..... 381/318, 312, 320, 71.11
See application file for complete search history.

(56) References Cited

U.S. PATENT DOCUMENTS 5,201,006 A 4/1993 Weinrich
5,680,467 A 10/1997 Hansen (Continued)

FOREIGN PATENT DOCUMENTS

WO WO 99/43185 A1 8/1999
WO WO 2005/107320 A1 11/2005
WO WO 2007/098808 A1 9/2007

OTHER PUBLICATIONS

Forssell et al. "Closed-loop Identification Revisited—Updated Version", Linkoping University, Sweden, pp. 1-55 (1998).

(Continued)

*Primary Examiner* — Duc Nguyen
*Assistant Examiner* — Taunya McCarty
(74) *Attorney, Agent, or Firm* — Birch, Stewart, Kolasch & Birch, LLP

(57) ABSTRACT

A hearing aid system includes an input transducer, an output transducer, and an electrical signal path between them. The signal path includes a signal processing unit. An electrical feedback cancellation path is formed between the output side and the input side of the signal path and subtracts an estimate of acoustical feedback from a signal on the input side of the amplifier part, the electrical feedback cancellation path including an adaptive filter for providing a variable filtering function. A probe signal generator generates a probe signal characterizing an acoustical feedback path, the probe signal being fed to the adaptive filter of the electrical feedback cancellation path. A second input transducer is located at a position where the acoustical signal is substantially free from acoustic feedback from the output transducer, and the adaptive filter uses a signal derived from the second electrical input signal to influence its filtering function.

12 Claims, 6 Drawing Sheets

External device and indirect identification

(56) References Cited

U.S. PATENT DOCUMENTS

| | | | | |
|---|---|---|---|---|
| 6,219,427 | B1 | 4/2001 | Kates et al. | |
| 6,549,633 | B1 | 4/2003 | Westermann | |
| 7,013,015 | B2 | 3/2006 | Hohmann et al. | |
| 7,043,037 | B2 | 5/2006 | Lichtblau | |
| 7,716,046 | B2 * | 5/2010 | Nongpiur et al. | 704/226 |
| 7,885,417 | B2 * | 2/2011 | Christoph | 381/71.11 |
| 2001/0002930 | A1 | 6/2001 | Kates | |
| 2002/0176594 | A1 | 11/2002 | Hohmann et al. | |
| 2004/0013280 | A1 * | 1/2004 | Niederdrank | 381/315 |
| 2007/0160242 | A1 * | 7/2007 | Cadalli et al. | 381/312 |

OTHER PUBLICATIONS

Haykin, "Linear Adaptive Filtering", Adaptive Filter Theory, Prentice Hall, 3rd edition, Part 3, Chapters 8-17, pp. 338-770 (1996).

Sayed, "Stochastic-Gradient Algorithms", Fundamentals of Adaptive Filtering, Chapter 5, pp. 212-280 (2003).

* cited by examiner

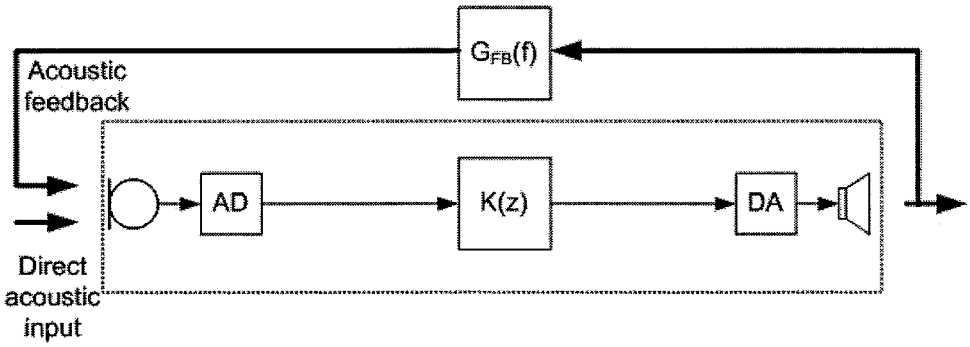
Fig. 1a -- PRIOR ART --
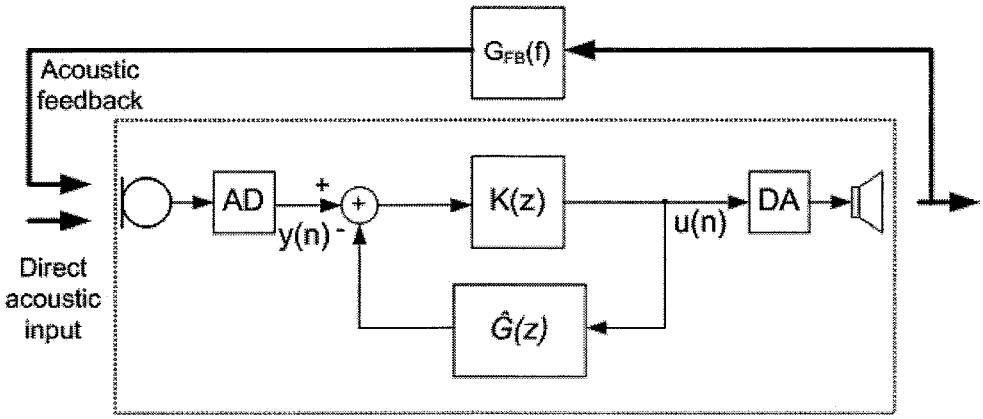
Fig. 1b -- PRIOR ART --
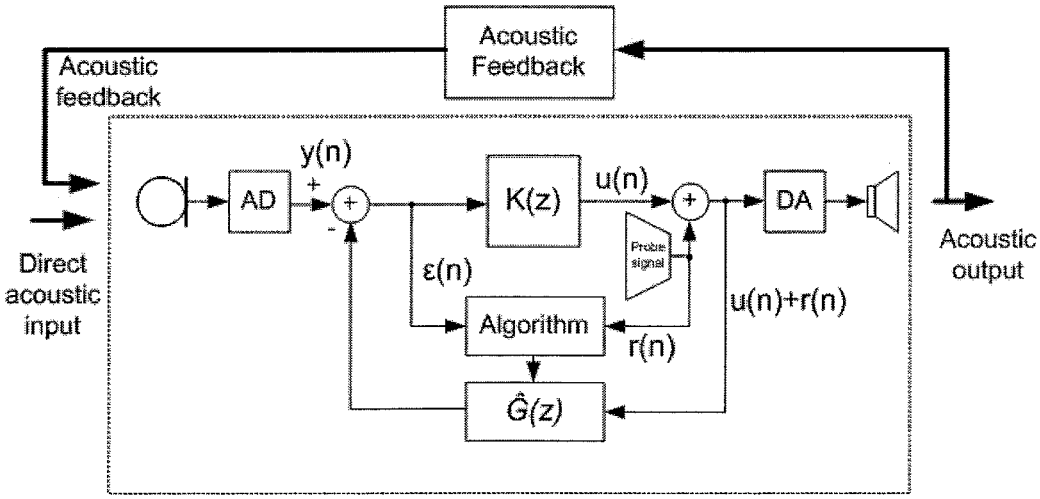
Fig. 1c -- PRIOR ART --

-- PRIOR ART --

External device and indirect identification

External device and indirect identification

External device and direct identification

HEARING AID SYSTEM WITH FEEDBACK ARRANGEMENT TO PREDICT AND CANCEL ACOUSTIC FEEDBACK, METHOD AND USE

TECHNICAL FIELD

The invention relates to hearing aids, and specifically to a hearing aid system with improved feedback cancellation, the system optionally comprising a generator of an electrical probe signal for use in characterizing the feedback path.

The invention furthermore relates to a method of compensating acoustic feedback in a hearing aid system and to the use a hearing aid system according to the invention.

BACKGROUND ART

The following account of the prior art relates to one of the areas of application of the present invention, acoustic feedback cancellation in a digital hearing aid. As is well-known, an oscillation due to acoustical feedback (typically from an external leakage path) and/or mechanical vibrations in the hearing aid can occur at any frequency having a loop gain larger than 1 (or 0 dB in a logarithmic expression), in other words for which the forward gain is larger than the leakage attenuation, AND at which the phase shift around the loop is an integer multiple of 360°. A schematic illustration of a hearing aid system is shown in FIG. 1*a*, the hearing aid system comprising an input transducer (here illustrated by a microphone) for receiving an acoustic input (e.g. a voice) from the environment, an analog-digital converter AD, a processing part K(z), a digital-analog converter DA and an output transducer (here illustrated by a speaker) for generating an acoustic output to the wearer of the hearing aid. The intentional signal path (or forward path) and components of the system are enclosed by the dashed outline. A frequency (f) dependent ('external', unintentional) acoustical feedback path $G_{FB}(f)$ from the output transducer to the input transducer is indicated.

Feedback reduction may e.g. be achieved

- by reducing gain at frequencies, where the above criteria are met, or
- by controlling the phase response around the loop to ensure a negative (rather than positive) feedback at frequencies, where the gain is large enough to cause oscillations, or
- by shifting the frequency of the signal from the input to the output of the amplifier, so that an oscillation at a given frequency cannot easily build up, or
- by adding an intentional feedback signal with a gain and phase response aimed at canceling the external leakage path.

The present application deals with feedback reduction of the latter nature (cf. FIG. 1*b*, where y(n) is the digital input signal, u(n) is the digital output signal, K(z) represents the electrical signal path (also termed the forward path) of the hearing aid including an amplifier and processor of the input signal, $G_{FB}(f)$ represents the acoustical/mechanical feedback path and $\hat{G}(z)$ represents an electrical estimate of the acoustical feedback (feedback cancellation path).

Feedback cancellation systems are known in the art, including such systems using an adaptive filter in the feedback cancellation path. An example of a prior art system of this kind is illustrated in FIG. 1*c*. The components and signals of FIG. 1*c* are identical to those of FIG. 1*b*, except that the component $\hat{G}(z)$ in FIG. 1*b* representing an estimate of the acoustical feedback, in FIG. 1*c* is exemplified as an adaptive filter comprising a variable filter part $\hat{G}(z)$ and an algorithm or estimation part Algorithm (e.g. a Least Mean Squares (LMS) filter algorithm for determining the filter coefficients of the variable filter part $\hat{G}(z)$). A digital probe signal, e.g. probe noise (cf. signal r(n) from the 'Probe signal' generator in FIG. 1*c*), may be used in hearing aid systems for improving determination of the feedback path from the speaker of a hearing aid to the microphone of the same hearing aid. In the embodiment of FIG. 1*c*, the probe signal r(n) is added to the digital output signal u(n) from the digital processing part K(z) and this signal u(n)+r(n) is fed to the output transducer and used as input to the variable filter part $\hat{G}(z)$ of the adaptive filter. The algorithm or estimation part receives as inputs to the estimation of the adaptive filter the probe signal r(n) and the digital input signal (also termed $\epsilon(n)$ (error signal) in the figure) to the amplifier/processing block K(z). This is known as the indirect identification method.

FIG. 2 shows a more general arrangement of the signal paths of a hearing aid system comprising feedback cancellation, where both indirect identification schemes ($k_r$=1, $k_u$=0, using a probe signal in the digital output) and direct identification schemes ($k_r$=0, $k_u$=1, no probe signal in the digital output signal used) are indicated. Alternatively, $k_r$=$k_u$=½, representing a scheme where equal amounts of the probe signal r(n) and the digital output signal u(n) are used as an input the algorithm part LMS. Other intermediate variants may be implemented by the arrangement in FIG. 2 (by allowing each of $k_u$ and $k_r$ to vary between 0 and 1). System identification using the indirect ($k_r$=1, $k_u$=0) and direct methods ($k_r$=0, $k_u$=1) are common knowledge in system identification and e.g. described in U. Forssell, L. Ljung, *Closed-loop Identification Revisited—Updated Version*, Linköping University, Sweden, LiTH-ISY-R-2021, 1 Apr. 1998.

In indirect identification, the probe signal is preferably inaudible to the user of the hearing aid. A feedback part of the probe signal is received at the microphone of the hearing aid together with ambient sound and feedback of the processed ambient sound. Hence the received signal by the microphone will be a mix of the ambient (and desired) signal and the (undesired) feedback signal from the output (including the probe noise).

The quality of the estimate of the feedback path depends on the ratio between the level of the probe signal and the level of the other signal of the microphone. The part of the microphone signal that does not originate from the probe noise will disturb the adaptation of the adaptive filter and will be called the "disturbing signal" below. The lower level of the disturbing signal, the better (more accurate) estimate or faster adaptation can be achieved.

U.S. Pat. No. 5,680,467 describes a hearing aid with an acoustic feedback compensation circuit comprising a noise generator for the insertion of noise, and an adjustable digital filter for the adaptation of the feedback signal, the adaptation involving statistical evaluation of the filter coefficients.

U.S. Pat. No. 7,013,015 describes a system for reducing feedback-conditioned oscillations in a hearing aid device, wherein microphone signals of a first microphone and of a distanced, second microphone are compared to one another. When oscillations are detected at the same frequency in both microphone signals, these oscillations are determined to be useful (non-feedback) tonal signals. Oscillations that are only present in one of the microphone signals, in contrast, are feedback-conditioned and are suppressed using suitable measures.

U.S. Pat. No. 6,549,633 describes a binaural hearing aid with signal processors in each unit, wherein a residual feedback signal representing the difference feedback signals from the actual and simulated sound processing channels is supplied and used to distinguish between howl and information sound signals of a similar character.

WO 2007/098808 describes a hearing aid with multiple microphones, directional processing means to form a spatial signal from the microphone signals, estimating means which are used to estimate feedback signals to each of the microphones and processing means to—based on the directional and feedback information—apply a gain not exceeding a resulting maximum gain limit to form a hearing loss compensation signal.

DISCLOSURE OF INVENTION

The object of the present invention is to provide an alternative scheme for estimating the acoustical/mechanical feedback in a hearing aid. It is a further object of the present invention to improve the quality of the feedback estimate compared to the prior art. It is a further object of an embodiment of the present invention to improve the estimate of the part of the microphone signal that does not originate from the probe signal. It is a further object of the present invention to provide a more accurate estimate and/or a faster adaptation.

One or more the objects are achieved by the invention described in the accompanying claims and as described in the following.

An object of the invention is achieved by a hearing aid system comprising a. a first input transducer for converting an acoustical signal to a first electrical input signal, the first electrical input signal comprising a direct part and an acoustic feedback part, b. an output transducer for generating an acoustical signal from an electrical output signal, c. an electrical signal path being defined between the input transducer and the output transducer and comprising a signal processing unit including an amplifier part for enabling frequency dependent gain of an input signal, the amplifier part defining an input side of the signal path between the input transducer and the amplifier part and an output side of the signal path between the amplifier part and the output transducer, d. an electrical feedback cancellation path between the output side and the input side of the signal path, for compensating acoustic feedback between the output transducer and the input transducer by subtracting an estimate of the acoustical feedback from a signal on the input side of the amplifier part, the electrical feedback cancellation path comprising an adaptive filter for providing a variable filtering function.

The hearing aid system according to the present invention is further adapted to provide a second electrical input signal essentially consisting of the direct part of said first electrical input signal, when the hearing aid system is in use, and the adaptive filter of the feedback cancellation path is adapted to use a signal derived from the second electrical input signal to influence, preferably enhance, its filtering function.

The term 'preferably enhance, its filtering function' is in the present context taken to mean providing an improved estimate of the acoustic feedback path, e.g. to provide a faster adaptation and/or a smaller deviation between the true and estimated acoustic feedback path.

The term the 'direct part' of the electrical input signal is taken to mean the 'external part' of the signal in question (as opposed to the feedback part).

In an embodiment, the second electrical input signal is fed to a feedback enhancer unit for preparing the derived signal from the second electrical input signal to influence, preferably enhance, the filtering function of the adaptive filter of the electrical feedback cancellation path. The output of the feedback enhancer unit constitutes an estimate of the direct (or external) part of the first electrical input signal. This has the advantage of improving the quality of the estimate of the acoustic feedback path (e.g. by providing an improved signal to noise ratio). In a particular embodiment, the feedback enhancer unit comprises a second adaptive filter for estimating the difference in path from the source to the first and second input transducers, respectively, and from the second input transducer to the feedback enhancer.

In an embodiment, the hearing aid system is adapted to provide that the second electrical input signal represents sound from a TV or any other sound signal (e.g. wirelessly transmitted directly to the hearing aid), which can also (at the same time) be present as an acoustical input at the first input transducer, when the hearing aid system is in use.

In a particular embodiment, the hearing aid system further comprises a second input transducer for converting an acoustical signal to a second electrical input signal, the second input transducer being located at a position where the acoustical signal is substantially free from acoustic feedback from the output transducer and wherein the adaptive filter of the feedback cancellation path is adapted to use the second electrical input signal derived from the second input transducer to influence, preferably enhance, its filtering function.

This has the advantage of providing an improved estimate of the part of the microphone signal that originates from the output of the hearing aid (identification signal).

In the present context, the term a second electrical input signal 'essentially consisting of the direct (or external) part of the first electrical input signal' is taken to mean that the direct (or external) part of the first electrical input signal is derivable (or predictable) from the second electrical input signal (e.g. because the acoustic source of the direct or external part of the signal is spatially quasi stationary), e.g. via a known or deterministic transfer function (e.g. mainly determined by the distance between the first and second input transducers relative to acoustic sources in the environment). In an embodiment, the transfer function from the first to the second input transducer (in the meaning including the difference in transfer function from the source to the first input transducer and from the source to the second input transducer) is estimated by an adaptive filter or the like. In an embodiment, the second electrical input signal consists essentially of a filtered version of the direct acoustic input (i.e. taking into account external acoustic path differences and possible wireless transmission from the second input transducer).

In an embodiment, the system of the feedback cancellation path is arranged according to the direct identification method (i.e. without any probe signal generator).

In a preferred embodiment, the system further comprises a generator of an electrical probe signal for use in characterizing the feedback path. In an embodiment, the system of the feedback cancellation path is arranged according to the indirect identification method.

In an embodiment, the second input transducer is located at a position where the acoustical signal from the output transducer at a given frequency (such as at essentially all relevant frequencies) is smaller than at the location of the first input transducer. Preferably, the sound level from the output transducer at the location of the second input transducer is 3 dB, such as 5 dB, such as 10 dB, such as 20 dB lower, such as 30 dB lower, such as 40 dB lower than at the first input transducer.

In an embodiment, the hearing aid system is body worn or capable of being body worn. In an embodiment, the first and second input transducers and the output transducer are located in the same physical body. In an embodiment, the hearing aid system comprises at least two physically separate bodies which are capable of being in communication with each other by wired or wireless transmission (be it acoustic, ultrasonic, electrical of optical). In an embodiment, the first input transducer is located in a first body and the second input transducer in a second body of the hearing aid system. In an embodiment, the first input transducer is located in a first body together with the output transducer and the second input transducer is located in a second body. In an embodiment, the first input transducer is located in a first body and the output transducer is located in a second body. In an embodiment, the second input transducer is located in a third body. The term 'two physically separate bodies' is in the present context taken to mean two bodies that have separate physical housings, possibly not mechanically connected or alternatively only connected by one or more guides for acoustical, electrical or optical propagation of signals.

In an embodiment, an input transducer is a microphone. In an embodiment, an output transducer is a speaker (also termed a receiver).

In an embodiment, an integrated processing circuit comprising the signal processing unit comprises the adaptive filter of the electrical feedback path as well. In an embodiment, the integrated processing circuit comprises the probe signal generator. In an embodiment, the integrated processing circuit comprises all digital parts of the part of the hearing aid system located in the same physical body and intended for being worn by a user (such as a hearing impaired person), e.g. at the ear or in the ear canal of a user.

In an embodiment, the signal path comprises a number of components or functional blocks and the electrical feedback cancellation path extends from the output of a component or functional block in the signal path to the input of a component or functional block in the signal path, the part of the signal path being looped by the feedback path including an or the amplifier of a signal derived from the first electrical input signal. In an embodiment, the signal path comprises an A/D-converter (for conversion of an analog output signal from the input transducer to a digital signal) and a D/A-converter (for conversion of a digital signal to an analog input signal to the output transducer). In an embodiment, the electrical feedback cancellation path extends from the input signal of the D/A-converter (or receiver) to the output signal from the A/D-converter (i.e. from the digital input to a speaker to the digital output of a microphone).

In an embodiment, the adaptive filter (e.g. $\hat{G}(z)$ in FIG. 1*b*) comprises a variable filter part (also termed $\hat{G}(z)$ in FIGS. 1*c* and 2, 3) and a control part ('Algorithm' in FIGS. 1*c*, 3 or LMS in FIG. 2) for estimating the filter coefficients of and controlling the variable filter part. The term 'control part' is used in the present context interchangeably with the terms 'update or algorithm or estimation part'.

In an embodiment, a probe signal is added to the signal of the signal path on the output side of the signal path (i.e. after the or an amplifying part of the signal path). Preferably the probe signal is added to the electrical feedback cancellation path and fed to the adaptive filter. In an embodiment, the digital output signal comprising the probe signal (signal u(n)+r(n) in FIGS. 1*c*, 3) is fed to the adaptive filter of the electrical feedback cancellation path (e.g. to a variable filter part ($\hat{G}(z)$ in FIGS. 1*c*, 3) for enabling a frequency dependent filtering function). Preferably, output signal u(n) and probe signal r(n) are substantially uncorrelated (ideally, the probe signal r(n) should be substantially uncorrelated to the direct part v(n) of the digital input signal of the first input transducer (i.e. without acoustical feedback), cf. FIG. 2). The terms 'probe signal' or 'probe noise signal' are used interchangeably in the present application, both terms indicating a generated signal intended to provide information about the acoustical feedback path AND intended to be non-distressing to a wearer of the hearing aid AND sufficiently different in frequency and/or amplitude characteristics compared to the 'natural' sound inputs to the hearing aid to allow some sort of differentiation on the input side of the hearing aid system. This is e.g. accomplished by shaping the probe noise signal based on a model of the human auditory system (psychoacoustic model). The probe signal is preferably adapted in level and/or frequency to the sensitivity of the human ear (either customized to the individual, wearing the hearing aid in question or to a generalised, 'standard person'). Generation of the probe noise signal may e.g. be based on a signal from the output side of the signal path (e.g. u(n) in FIGS. 1*c*, 3), optionally in combination with a psychoacoustic model (i.e. a model based on the human auditory sensory system, which takes into account characteristics of the human ear and the perception of sound by the human brain). Examples of appropriate probe noise signals are e.g. given in U.S. Pat. No. 5,680,467 (e.g. pseudo-random signal generators as shown FIGS. 4 and 5 of that reference). In an embodiment, the probe signal is generated by a random signal generator (possibly adapted in level to a particular user, as indicated above).

In an embodiment, the probe signal (r(n) in FIGS. 1*c*, 3 or e.g. for $k_r$=1, $k_u$=0 in FIG. 2) is fed to the adaptive filter (e.g. to an algorithm or estimation part of the adaptive filter) and used to adapt the filtering function of the adaptive filter (indirect identification).

In an embodiment, the output signal from the processing block (u(n) in FIG. 2, for $k_r$=0, $k_u$=1) is fed to the adaptive filter (e.g. to an algorithm or estimation part of the adaptive filter) and used to adapt the filtering function of the adaptive filter (direct identification).

In an embodiment, the estimate of the acoustical feedback path (i.e. e.g. the output of the variable filter part of the adaptive filter ($\hat{G}(z)$ in FIG. 3)) is subtracted from the digital input signal from the first input transducer and fed to the signal processing unit. In an embodiment, this 'error' signal ($\epsilon(n)$ in FIG. 3) subtracted by an estimate of the direct (or external) part of the first electrical input signal (as e.g. supplied by the output of the feedback enhancer unit, $H_{est}(z)$ in FIG. 3) is fed to the adaptive filter (e.g. to an algorithm or estimation part of the adaptive filter) and used to adapt the filtering function of the adaptive filter. Alternatively, the estimate of the direct (or external) part of the first electrical input signal may be used directly by the adaptive filter of the feedback cancellation path (cf. FIGS. 4, 5) to adapt the filtering function (i.e. to estimate the feedback path).

The adaptive filter may e.g. be a FIR-filter or an IIR-filter. In an embodiment, the adaptive filter is a digital filter comprising a variable filter part for enabling a frequency dependent filtering function and a control part (or update or algorithm or estimation part) for controlling the characteristics of the frequency dependent filtering function. In the present context, the term 'filtering function' is taken to mean the function of enabling a frequency dependent shaping of an input signal according to given criteria. The term 'variable filtering function' is hence taken to indicate that the criteria determining the shaping of the input signal can vary (i.e. be time dependent). By 'shaping' is meant the control of the amplitude or level and/or phase of the electrical signal over a specific frequency range. In an embodiment, the control part (algorithm) of the adaptive filter is based on some sort of mathematical algorithm to find the filter coefficients (to be used to update the variable filter part). In an embodiment the algorithm is a Least Means Squared (LMS) algorithm or a Recursive Least Squares (RLS) algorithm or other appropriate prediction error methods. In a particularly embodiment, the control part of the adaptive filter is based on the projection method, which is particularly advantageous in connection with the use of probe noise in feedback estimation (cf. e.g. U. Forssell, L. Ljung, *Closed-loop Identification Revisited—Updated Version*, Linköping University, Sweden, LiTH-ISY-R-2021, 1 Apr. 1998, pp. 19, ff.). In an embodiment, the filter coefficients of the variable filter part are updated from the control part every time instant of the digital signal processing unit, optionally according to a predefined scheme, e.g. at least every time the feedback path estimate has changed. Adaptive filters and appropriate algorithms are e.g. described in Ali H. Sayed, *Fundamentals of Adaptive Filtering*, John Wiley & Sons, 2003, ISBN 0-471-46126-1, cf. e.g. chapter 5 on *Stochastic-Gradient Algorithms*, pages 212-280, or Simon Haykin, *Adaptive Filter Theory*, Prentice Hall, 3rd edition, 1996, ISBN 0-13-322760-X, cf. e.g. Part 3 on *Linear Adaptive Filtering*, chapters 8-17, pages 338-770.

Feedback cancellation systems using the indirect identification method are rarely used during operation of the hearing aid because of the poor SNR of the error signal due to the restriction that the noise should not be disturbing/audible to a user (cf. $\epsilon(n)$ in FIG. 1*c*, the ratio of the external signal and the (error) signal of interest). Some systems use the indirect method during the initial fitting of the hearing aid (where key parameters or options are adapted to a particular user's needs). Some systems use the indirect method when the hearing aid is turned on (after having been turned off, e.g. over night) in order to estimate the 'static' part of the feedback path or to adapt key parameters.

Therefore there is a need for a feedback cancellation system comprising a probe signal generator for use in an indirect detection configuration (cf. FIGS. 1*c*, 2 (with $k_r$=1, $k_u$=0) 3, 4), which method improves the SNR on the error signal while the hearing aid is in normal operation. An embodiment of the present invention makes use of the characteristic that the 'disturbing signal' (i.e. the external signal or the part of the acoustic feedback signal that does not originate from the probe noise signal) is present on the first as well as the second input transducer (1st mic. or mic. 1 and 2nd mic. and mic. 2, respectively, in FIGS. 3, 4, e.g.), whereas the probe signal (ideally) is only present on the first input transducer (1st mic or mic. 1). It is thereby possible to predict the disturbing signal on the first input transducer based on the signal from second input transducer (if the disturbing signal is spatially quasi stationary) and thereby lowering the disturbing signal without removing the probe signal (and in that way increase the SNR). To use the spatial information/characteristics and to cancel a single feedback path, two microphones and two parallel running adaptive systems are needed, one to predict the input at the first input transducer from the second input transducer and one to cancel the feedback path. This new spatial arrangement surprisingly shows a very large increase in the SNR (on the error signal) and it is thereby especially advantageous to use in an indirect identification arrangement (cf. FIGS. 3, 4). It can, however, advantageously also be used with a direct identification arrangement (cf. e.g. FIG. 5) to lower correlation between the reference signal (output of the hearing aid) and the disturbing signal.

According to an embodiment of the present invention the disturbing signal—i.e. the part of the (first) input transducer signal that does not originate from the probe signal—can be estimated from a second or additional input transducer (e.g. a microphone) signal, which is substantially free from the probe signal, and be subtracted from the (first) input transducer signal. In an embodiment, the electrical signal of the second input transducer is filtered and subtracted from the feedback corrected input signal and fed to the control part ('Algorithm' in FIG. 3*a*) of the adaptive filter of the feedback cancellation path and used to adapt the filtering function of the adaptive filter (e.g. by determining the filter coefficients used in the variable filter part) as shown in FIG. 3. In an embodiment, an additional (e.g. second) input transducer is an input transducer located further apart from the output transceiver than the first transducer but being part of the same hearing aid as the first transducer (i.e. intended for use at the same ear). In an embodiment, an additional (e.g. second) input transducer is a microphone of some other apparatus with which the hearing aid can communicate. Specifically, the corrective signal could be based on a microphone signal of the other hearing aid in a binaural fitting. In an embodiment, the second or additional input transducer is a microphone of a mobile telephone or some other communications device (e.g. a remote control unit for the hearing aid or a body worn audio selection device) being able to communicate, by wire or wirelessly, with the hearing aid, as shown in FIGS. 3, 4, 5 below. In an embodiment, the other apparatus (comprising the second input transducer) can communicate with the hearing aid via a wireless communications standard, e.g. BlueTooth (cf. e.g. 'Wireless transmission' in FIG. 3). In a particular embodiment, the other apparatus is body worn or capable of being body worn by the person wearing the hearing aid (here hearing aid is used in the meaning 'the part of the hearing aid system comprising the receiver').

In an embodiment, a compensation of the delay of the signal from the first to the second or additional input transducer and back to the signal processing part of the hearing aid system is implemented. This can e.g. be done by inserting delay components appropriately delaying signals providing inputs to the control part (Algorithm in FIG. 1*c*) of the adaptive filter of the feedback path, i.e. signals r(n) and $\epsilon(n)$ in FIG. 1*c*, as e.g. illustrated in FIG. 3*b*.

In an embodiment, the hearing aid system comprises a second adaptive filter (in addition to the (first) adaptive filter of the feedback cancellation path) for estimating the first electrical input signal of the first input transducer by means of the second electrical input signal from the second input transducer of the hearing aid system. The second adaptive filter, representing an embodiment of the 'Feedback enhancer' in FIGS. 4, 5, can e.g. be inserted in the electrical path between the second input transducer and the electrical feedback cancellation path (cf. also $H_{est}(z)$ in FIG. 3*a* or $H_{est}(z)$ and Algorithm in FIG. 3*b*) to estimate the differences in acoustical transfer functions from the acoustic source to the first input transducer and to the second input transducer, respectively, (for simplicity indicated by H(f) in FIG. 3*a*) and the transfer function from the second input transducer to the input of the second adaptive filter (including the wireless link). In an embodiment, a corresponding electrical signal is subtracted from the feedback corrected (and possibly appropriately delayed) input signal ($\epsilon(n)$ in FIG. 3) from the first input transducer before feeding it to the control part (Algorithm in FIG. 3) of the adaptive filter of the electrical feedback cancellation path. The delay is intended to compensate the delay of the signal from the first to the second or additional input transducer and back to the signal processing part of the hearing aid system (Feedback enhancer in FIGS. 4, 5). Preferably, corresponding delays are inserted in both input paths of the adaptive filter of the electrical feedback cancellation path. Alternatively, the output from the feedback enhancer can be used alone as input to the control part of the adaptive filter of the electrical feedback cancellation path (i.e. fed directly to block Adaptive shadow system in FIG. 4, without being subtracted from the feedback corrected input signal as in FIG. 3).

In an embodiment, the signal from the second or additional input transducer is streamed in real time to the signal processing part of the hearing aid. This can e.g. be done by available wireless technologies, cf. e.g. the nRF24Z1 transceiver for audio streaming from Nordic Semiconductor (Oslo, Norway). In an embodiment, one or more selected frequency ranges or bands of the signal from the second input transducer is streamed to the part of the system housing the signal processing part of the hearing aid (including the adaptive filter of the electrical feedback cancellation path). This has the advantage of saving transmission bandwidth and thus power, which is a key parameter. In an embodiment, only relatively low frequency bands or ranges are streamed. In an embodiment, the streamed band or bands are selected from the frequency range between 20 Hz and 4 kHz, such as from 500 Hz to 3 000 Hz, such as from 1 kHz to 2 kHz.

In a further aspect a further hearing aid system is provided.

It is intended that the structural features of the hearing aid system described above, in the detailed description of 'mode(s) for carrying out the invention' and in the claims can be combined with the further hearing aid system outlined below. Embodiments of the further hearing aid system described below have the same advantages as the corresponding hearing aid systems described above.

The further hearing aid system comprises a) a first input transducer for converting an acoustical signal to a first electrical input signal comprising a direct or external part and an acoustical feedback part, b) an output transducer for generating an acoustical signal from an electrical output signal, c) an electrical signal path being defined between the input transducer and the output transducer and comprising a signal processing unit including an amplifier part for enabling frequency dependent gain of an input signal, the amplifier part defining an input side of the signal path between the input transducer and the amplifier part and an output side of the signal path between the amplifier part and the output transducer, d) an electrical feedback cancellation path between the output side and the input side of the signal path for compensating acoustic feedback between the output transducer and the input transducer by subtracting an estimate of the acoustical feedback from a signal on the input side of the amplifier part, the electrical feedback cancellation path comprising an adaptive filter for providing a variable filtering function, e) a feedback enhancer unit, providing an output signal for improving the estimate of the feedback cancellation path made by the adaptive filter, the output of the feedback enhancer unit constituting an estimate of the direct or external part of the first electrical input signal, the hearing aid system being further adapted to provide a second electrical input signal from which the direct or external part of said first electrical input signal can be estimated, the second electrical input signal being connected to the feedback enhancer unit.

A method of compensating acoustic feedback in a hearing aid system is furthermore provided by the present invention.

It is intended that the features of the hearing aid system described above, in the detailed description and in the claims can be combined with the method as described below (when appropriately converted to process features).

The method comprises a) providing a first input transducer for converting an acoustical signal to a first electrical input signal, the first electrical input signal comprising a direct or external part and an acoustic feedback part, b) providing an output transducer for generating an acoustical signal from an electrical output signal, c) providing an electrical signal path between the input transducer and the output transducer, the signal path comprising a signal processing unit including an amplifier part for enabling frequency dependent gain of an input signal, the amplifier part defining an input side of the signal path between the input transducer and the amplifier part and an output side of the signal path between the amplifier part and the output transducer, d) providing an electrical feedback cancellation path between the output side and the input side of the signal path for compensating acoustic feedback between the output transducer and the input transducer by subtracting an estimate of the acoustical feedback from a signal on the input side of the amplifier part, the electrical feedback cancellation path comprising an adaptive filter for providing a variable filtering function, f) providing a second electrical input signal consisting essentially of the direct or external part of said first electrical input signal, g) providing that the second electrical input signal is used to influence, preferably enhance, the filtering function of the adaptive filter of the feedback cancellation path.

The method has the same advantages as the corresponding hearing aid system.

In a preferred embodiment, the second electrical input signal represents sound from a TV or any other sound signal, which is also present as an acoustical input at the first input transducer. In an embodiment, the second electrical input signal is transmitted from a physically separate device, e.g. from a TV—or other entertainment apparatus, from a mobile telephone, from a personal digital assistant, or from an audio selection device adapted for selecting an audio signal from a number of audio signals received by the audio selection device.

In a particular embodiment, the method comprises h1) providing that the second electrical input signal is generated by a second input transducer for converting an acoustical signal to an electrical signal, and providing that the second input transducer is located at a position where the amplitude of the acoustical signal from the output transducer is attenuated (preferably substantially eliminated), e.g. a factor of more than 2 or 5 or 10, such as more than 100, such as more than 1000, compared to the level at first input transducer.

In an embodiment, the second electrical input signal is transmitted from a device comprising the second input transducer, e.g. from a mobile telephone, from a personal digital assistant, or from an audio selection device adapted for selecting an audio signal from a number of audio signals received by the device.

In an embodiment, the method comprises h2) providing a generator of an electrical probe signal for use in characterizing the feedback path. In an embodiment, the probe signal is fed to the adaptive filter of the feedback cancellation path and used to adapt the filtering function of the adaptive filter.

In an embodiment, a compensation of the delay of the signal from the device or component generating the second electrical input signal, e.g. the device comprising the second input transducer, to the signal processing part of the hearing aid system is provided.

In an embodiment, a second adaptive filter for estimating the path of the second input transducer is provided. In an embodiment, a second adaptive filter (in addition to the (first) adaptive filter of the feedback cancellation path) for estimating the difference in acoustic paths from the acoustic source to the first and second input transducers, respectively, and back to the first adaptive filter is provided.

In an embodiment, the signal from the second input transducer is streamed to the signal processing part of the hearing aid system.

Use of a hearing aid system according to the invention as described above, in the detailed part of the description, and in the claims is moreover provided by the present invention. The use has the same advantages as the corresponding hearing aid system.

Further objects of the invention are achieved by the embodiments defined in the dependent claims and in the detailed description of the invention.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present. Furthermore, "connected" or "coupled" as used herein may include wirelessly connected or coupled. As used herein, the term "and/or" includes any and all combinations of one or more of the associated listed items.

BRIEF DESCRIPTION OF DRAWINGS

The invention will be explained more fully below in connection with a preferred embodiment and with reference to the drawings in which:

FIG. 1 shows various schematic illustrations of hearing aid systems, FIG. 1*a* illustrating the forward path and an acoustic feedback path, FIG. 1*b* illustrating signal paths and transfer functions (including an external leakage (or acoustic feedback) path) of a hearing aid system comprising an intentional feedback signal with a gain and phase response aimed at canceling the external leakage path, and FIG. 1*c* illustrating digital signals of a hearing aid system as in FIG. 1*b*, wherein an adaptive filter is used in the feedback path and further comprising a probe signal generator for use in the estimate of the feedback path.

Figure 2:
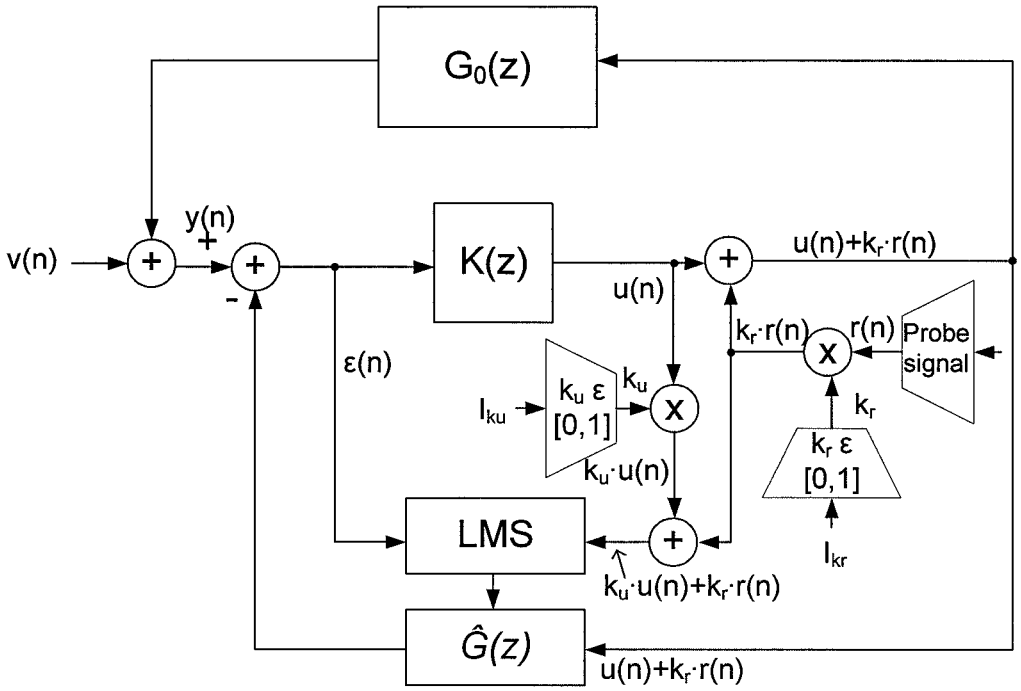
FIG. 2 shows a more general arrangement of the digital signal paths of a hearing aid system comprising feedback cancellation, where both indirect identification ($k_r$=1) and direct identification ($k_r$=0) schemes and intermediate variants (implemented by allowing $k_r$ and $k_u$ to vary independently between 0 and 1) are indicated.

The figures are schematic and simplified for clarity, and they just show details which are essential to the understanding of the invention, while other details are left out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

FIG. 1*a* is schematic illustration of a hearing aid system with a forward path comprising a microphone for receiving an acoustic input from the environment, an AD-converter, a processing part K(z), a DA-converter and a speaker for generating an acoustic output to the wearer of the hearing aid. The intentional signal paths and components of the system are enclosed by the dashed outline. An (external, unintentional, frequency dependent (f)) acoustical feedback path $G_{FB}(f)$ from the speaker to the microphone is indicated. The acoustic input from the acoustical feedback path is indicated as Acoustic feedback and the acoustic input from other sources in the acoustic environment is denoted Direct acoustic input in FIG. 1*a* (and likewise in FIGS. 1*b* and 1*c*).

FIG. 1*b* shows signal paths and transfer functions (including an external leakage path) of a prior art hearing aid system comprising an intentional electric feedback signal with a gain and phase response $\hat{G}(z)$ aimed at canceling the external leakage path. FIG. 1*c* shows a prior art hearing aid system as in FIG. 1*b*, wherein the feedback path comprises an adaptive filter comprising an Algorithm part and a variable filter part $\hat{G}(z)$.

In FIGS. 1*b* and 1*c*, y(n) is the digital input signal (e.g. from an A/D-converter connected to an input transducer, such as a microphone, i.e. comprising a feedback part and a direct part), u(n) is the digital output signal (e.g. to a D/A-converter connected to an output transducer, such as a speaker), K(z) represents the signal path (also termed the forward path) of the hearing aid including an amplifier of the input signal. $G_{FB}(f)$ (FIG. 1*b*) and Acoustical Feedback (FIG. 1*c*), respectively, represents the acoustical/mechanical feedback path. $\hat{G}(z)$ (FIG. 1*b*) and Algorithm+$\hat{G}(z)$ (FIG. 1*c*), respectively, denote an electrical feedback path (feedback cancellation path) representing an estimate of the acoustical feedback. r(n) (in FIG. 1*c*) is a probe signal optionally introduced in the signal path to be included in the digital output signal (u(n)+r(n)) as well as in the electrical feedback (here with the aim of improving the estimate of acoustical feedback). y(n) is the sum of the (desired or target) sound signal from the environment and the (undesired) acoustical feedback signal and $\epsilon(n)$ (error signal) is the corrected version of that signal (i.e. $\epsilon(n)$ is y(n) subtracted the estimate of the acoustical feedback signal from the feedback cancellation path), which is fed to the Algorithm part of the adaptive filter (and to the amplifier part K(z)) together with the probe signal r(n) (reference signal) for estimating the filter coefficients of the variable filter part $\hat{G}(z)$.

FIG. 2 shows a more general arrangement of the digital signal paths of a hearing aid system comprising feedback cancellation, where both indirect identification ($k_r$=1, $k_u$=0) and direct identification ($k_r$=0, $k_u$=1) schemes are indicated. The components and signals of FIG. 2 are identical to those of FIG. 1*c*, except that the control part of the adaptive filter (termed Algorithm in FIG. 1*c*) in FIG. 2 is termed LMS (here indicating a Least Mean Squares filter algorithm for determining the correction factors for the filter coefficients of the variable filter part). The control part LMS receives inputs to the control of the adaptive filter from the digital output from the amplifier or processing part K(z) and from a probe signal in dependence of a $k_u$- and a $k_r$-value being 0 or 1 (or any value there between), selectable by an input $I_k$ to the k-generators ($I_{kr}$, $I_{ku}$ respectively, $k_u$, $k_r$=[0;1] in FIG. 2), written in generalized form as $k_u \cdot u(n)+k_r \cdot r(n)$ (i.e. equal to u(n) for $k_r$=0(and $k_u$=1) and r(n) for $k_r$=1 (and $k_u$=0)) AND from the corrected input signal, termed ϵ(n) (error signal) in the figure, to the amplifier or processing part K(z). The digital electrical equivalence of the acoustical feedback path is termed $G_0(z)$ and the digital input signal of the acoustical source of the first input transducer (without the acoustical feedback signal) is termed v(n). The probe signal r(n) of the probe signal generator Probe signal can be one predetermined, e.g. random, signal, or it can be selected among a number of predefined probe signals or be generated by defining a specific key for a probe signal algorithm, optionally in dependence of one or more parameters of the hearing aid system related to the present acoustical environment, user hearing profile characteristics, a model of the human auditory system, etc. The input to the variable filter part $\hat{G}(z)$ is based on the digital output from the amplifier or processing part K(z) and from the probe signal generator in dependence of the $k_r$-value being between 0 and 1, i.e. equal to $u(n)+k_r \cdot r(n)$. In other words the input to the variable filter part $\hat{G}(z)$ comprises the digital output signal u(n) overlaid or superimposed with a weighted amount of the probe noise signal.

FIG. 3 shows an embodiment of a hearing aid system according to the invention using indirect identification and a microphone input from an external device, the signal path from the external device comprising a 'feedback enhancer unit'.

Figure 3A:
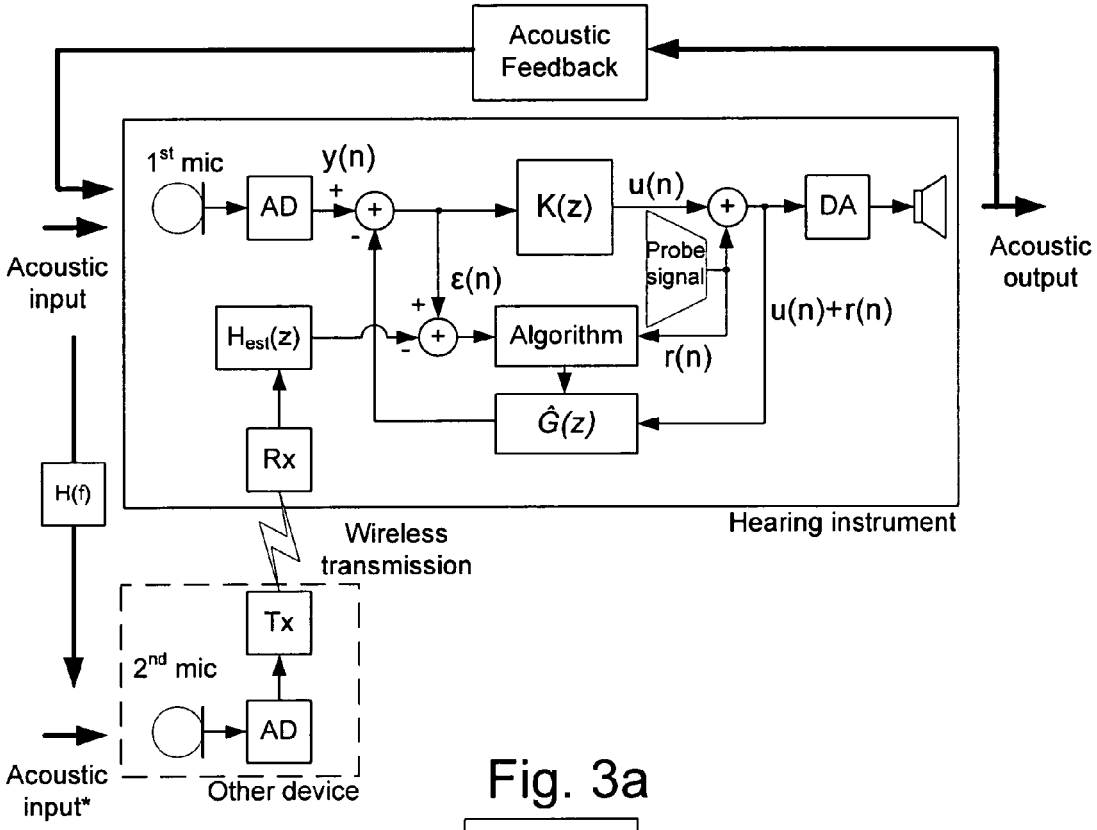
FIG. 3 shows an embodiment of a hearing aid system according to the invention using indirect identification and a (second) microphone input from an external device, the signal path from the external device comprising a feedback enhancer unit FIG. 3*a*, in FIG. 3*b* in the form of an adaptive filter.

FIG. 3*a* shows an embodiment of a hearing aid system according to the invention comprising at least two separate physical bodies, a first body being a hearing instrument (Hearing instrument) comprising the components illustrated in FIG. 1*c* (including a first input transducer ($1^{st}$ mic)) and a second body (Other device) comprising a second input transducer in the form of a microphone ($2^{nd}$ mic). The second microphone can be part of a pair of binaural hearing instruments and located in the instrument on the opposite ear to that of the first microphone. Alternatively, it can be located in another, preferably body worn device, located in the neighborhood of the first input transducer and being connected (or connectable) to it by a wireless or wired connection. Here a wireless connection (wireless transmission), e.g. Bluetooth or an inductive link, is indicated by transmission unit (Tx) (in the other device) for transmitting the, here digitized (by AD-converter AD), signal of the second microphone ($2^{nd}$ mic) and the wireless receiver unit (Rx) for receiving the signal in the hearing instrument. The second microphone ($2^{nd}$ mic) should preferably be located relative to the first microphone to minimize the contribution at the second microphone of acoustical feedback from the receiver of the hearing instrument. In an embodiment, the system—when worn by a user—is adapted to provide that the acoustic input signal (Acoustic input*) at the location of the second input transducer is substantially free from acoustic feedback. Typically, a transfer function H(f) (f=frequency) for the acoustic signal from the first to the second microphone, as indicated in FIG. 3*a*, exists (i.e. Acoustic input* represents Acoustic input modified by the transfer function H(f), where Acoustic input includes a 'direct part' and a 'feedback part'). The feedback enhancer unit $H_{est}(z)$ attempts to estimate the difference in acoustic path from the first to the second microphone and from the second microphone to the feedback enhancer unit. A corresponding electrical signal is subtracted from the feedback corrected input signal (ϵ(n) in FIG. 3*a*) from the first input transducer before feeding it to the control part (Algorithm in FIG. 3) of the adaptive filter of the electrical feedback cancellation path. Preferably, the distance between the first and second microphones (when operable to communicate) is less than 5 m, such in the range from 2 to 3 m, such as less than 1 m, such as less than 0.5 m, such as less than 0.3 m, such as less than 0.2 m. In an embodiment, the distance between the first and second microphones (when operable to communicate) is larger than 2 mm, such as larger than 5 mm, such as larger than 10 mm (e.g. in the range from 2 mm to 20 mm), such as larger than 0.2 m, such as in the range from 0.2 m to 1 m. In an embodiment, the distance between the first and second microphones (when operable to communicate) is smaller than 30 m, such as smaller than 20 m, such as smaller than 10 m.

Figure 3B:
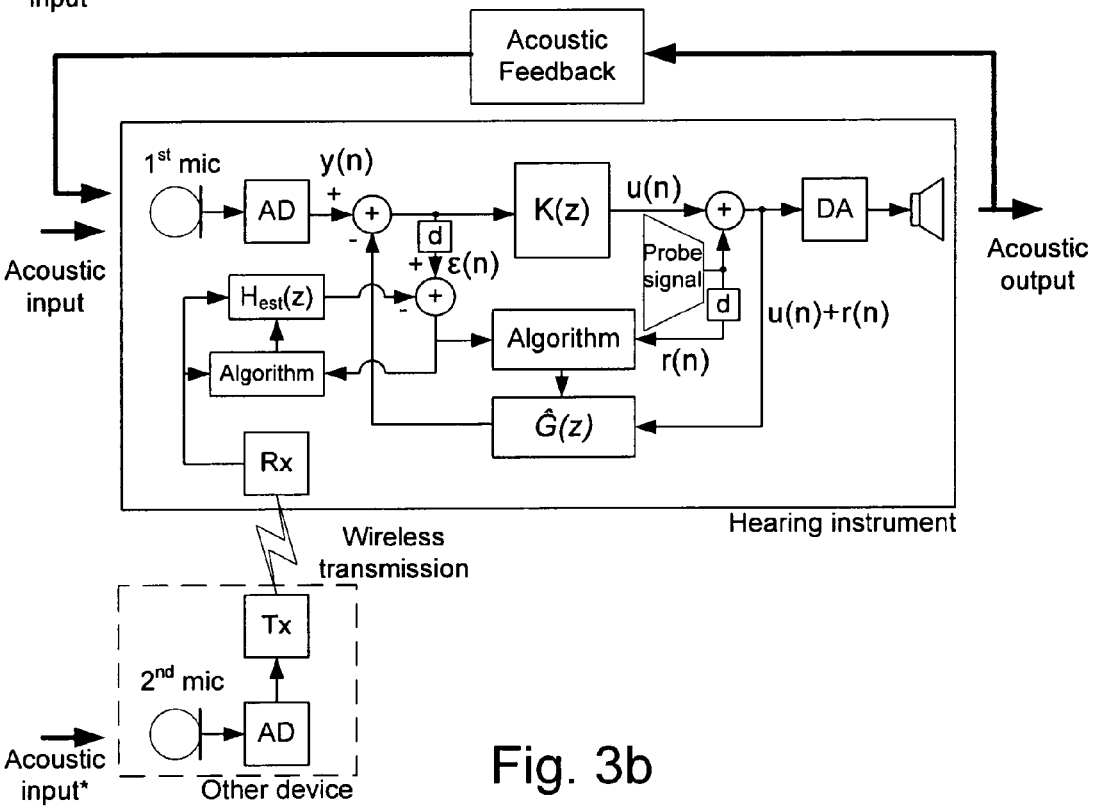

FIG. 3*b* shows an embodiment as shown in FIG. 3*a* wherein the feedback enhancer unit ($H_{est}(z)$ in FIG. 3*a*) is implemented by a second adaptive filter ($H_{est}(z)$, Algorithm in FIG. 3*b*). The (possibly pre-processed) digitized electrical signal from the second microphone ($2^{nd}$ mic) received by the hearing instrument (comprising components within the dotted outline denoted Hearing instrument) is used as input to the control (Algorithm) and variable filter ($H_{est}(z)$) parts of the second adaptive filter. The output from the variable filter ($H_{est}(z)$) part is subtracted from the feedback corrected input signal (ϵ(n) in FIG. 3*b*) from the first input transducer and fed to the control parts (Algorithm) of the adaptive filter of the feedback cancellation path as well as of the second adaptive filter.

Preferably, a compensation of the delay of the signal from the first to the second (here external) microphone and back to the signal processing part of the hearing aid system (here feedback enhancer unit) is inserted. This can e.g. be done by inserting delay components appropriately delaying signals providing inputs to the control part (Algorithm in FIGS. 3*a*, 3*b*) of the adaptive filter of the feedback path, i.e. delaying signals r(n) and ϵ(n) in FIGS. 3*a*, 3*b*. This is illustrated in FIG. 3*b* by delay components d.

Figure 4A:
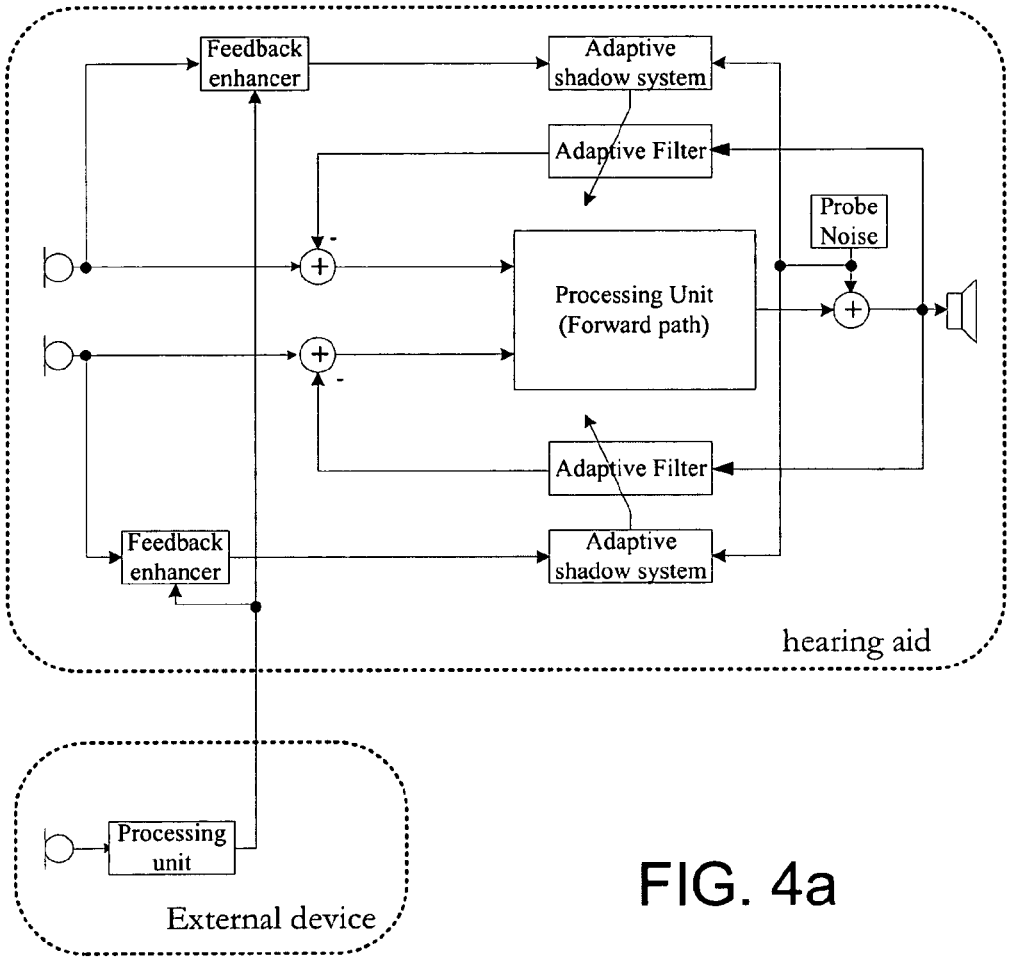
FIG. 4 shows a schematic diagram of a hearing aid system with indirect identification according to an embodiment of the invention comprising a second microphone signal from an external device, FIG. 4*a* illustrating an embodiment with a dual microphone set up in the main body of the hearing aid (e.g. in a BTE body or a ITE body of the hearing aid), FIG. 4*b* illustrating an embodiment where a single microphone in the main body of the hearing aid is used together with a microphone of an external device.
Figure 4B:
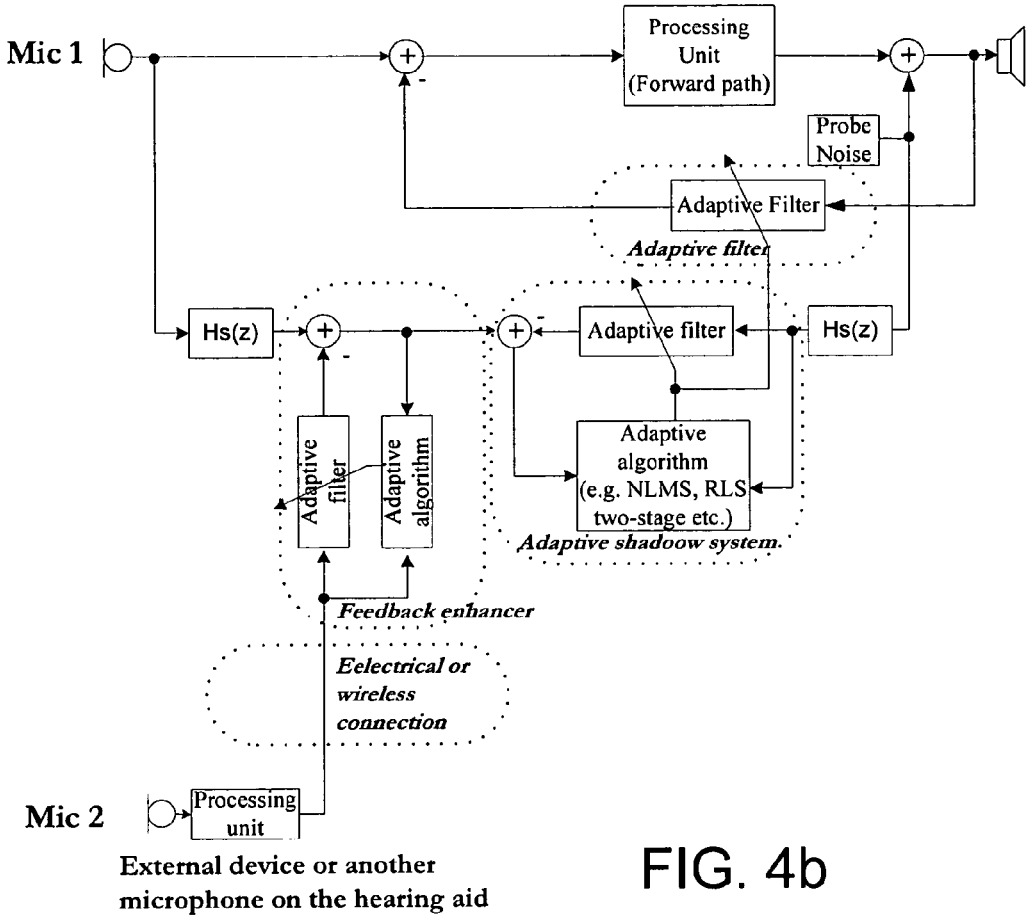

The control part (Algorithm) of the adaptive filter of the electrical feedback path of the embodiments shown in FIGS. 3*a*, 3*b* can preferably be implemented as detailed out in the Adaptive shadow system of FIG. 4*b*.

FIG. 4 shows a schematic diagram of a hearing aid system with indirect identification according to an embodiment of the invention comprising a second microphone signal from an external device.

FIG. 4*a* shows a hearing aid system comprising a hearing instrument (hearing aid) intended for being worn in or at an ear of a user, the instrument comprising two microphones (thereby improving directional perception), each having a separate electrical feedback path comprising an adaptive filter, each adaptive filter comprising a control part (Adaptive shadow system, which is further detailed out in FIG. 4*b*) and a variable filter part (Adaptive filter). A Probe Noise generator adds a probe noise signal to the output signal from the Processing Unit (Forward path), which is fed to a receiver for presenting an acoustical output signal to a wearer of the hearing instrument. The probe signal is further used as input to the control parts (Adaptive shadow system) of the adaptive filters of the feedback paths. A (second) input transducer (here microphone) of an External device (external relative to the physical body comprising the first input transducer, the first input transducer of the hearing aid here in the form of the two microphones) comprising a Processing unit is electrically connected (e.g. wirelessly) to two Feedback enhancer units of the hearing instrument. The Feedback enhancer units are inserted in the path between the electrical microphone input signal and the control part of the adaptive filter of each of the two electrical feedback paths.

FIG. 4*b* shows another embodiment of a hearing aid system according to the invention. The adaptive feedback enhancer (Feedback enhancer) tries to produce a minimum error signal between mic 1 and mic 2 and thereby enhancing the probe noise to the system identification block, in this block diagram named Adaptive shadow system. The forward path comprises a Processing Unit (Processing Unit (Forward path)) adapted to compensate for a hearing loss of a specific wearer. The blocks Hs(z) compensate for some difference of the transfer functions from the acoustic source to Mic 1 and to Mic 2 and back to the feedback enhancer unit (e.g. the 'static' part, incl. the delay). The Feedback enhancer tries to minimize the output from the enhancer, by controlling the adaptive filter, and thereby enhancing the signal that originates from the probe noise part of the output of the hearing aid. The Adaptive shadow system tries to minimize the error between the output from the adaptive filter of the feedback path (Adaptive filter) and the output from the feedback enhancer and thereby estimating the feedback path. The Adaptive filter is the filter, which performs the feedback cancellation, by using the estimate of the feedback path, from the adaptive shadow system.

Figure 5:
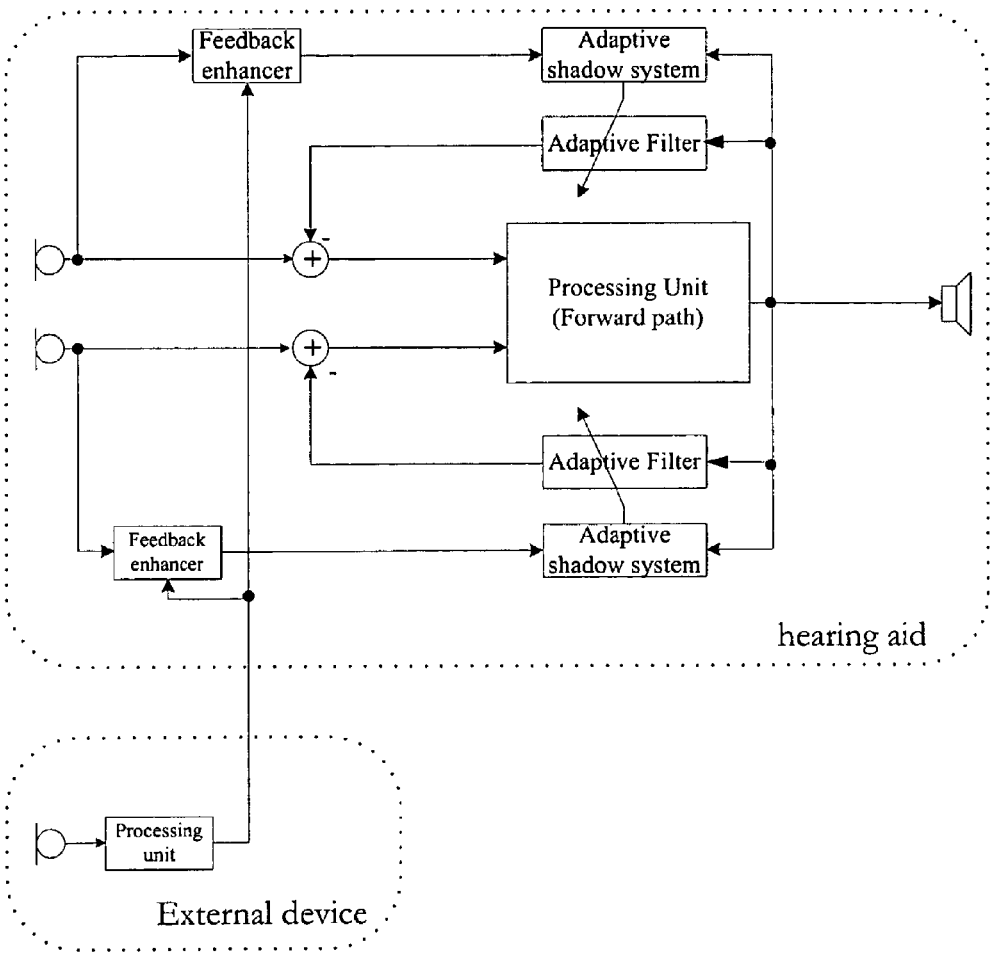
FIG. 5 shows a schematic diagram of a hearing aid system with direct identification according to an embodiment of the invention comprising a second microphone signal from an external device.

The probe noise generator may optionally be omitted so that the output from the Processing Unit is used directly as input to the adaptive filter of the feedback cancellation path (cf. FIG. 5).

FIG. 5 shows a schematic diagram of a hearing aid system with direct identification according to an embodiment of the invention comprising a second microphone signal from an external device. The embodiment is equivalent to that of FIG. 4*a*, only it does not contain a probe noise generator, so the output from the Processing Unit (Forward path) is fed directly to the adaptive filters of the feedback paths of the hearing instrument.

Preferably, a compensation of the delay of the signal from the second (e.g. external) microphone to the signal processing part of the hearing aid system is inserted (cf. also Hs(z) blocks in the embodiment of FIG. 4*b*).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

U.S. Pat. No. 5,680,467 (GN Danavox) 21 Oct. 1997

U.S. Pat. No. 7,013,015 (Siemens Audiologische Technik) 28 Nov. 2002

U.S. Pat. No. 6,549,633 (Widex) 26 Aug. 1999

U. Forssell, L. Ljung, Closed-loop Identification Revisited—Updated Version, Linköping University, Sweden, LiTH-ISY-R-2021, 1 Apr. 1998

Ali H. Sayed, Fundamentals of Adaptive Filtering, John Wiley & Sons, 2003, ISBN 0-471-46126-1

Simon Haykin, Adaptive Filter Theory, Prentice Hall, 3rd edition, 1996, ISBN 0-13-322760-X.

The invention claimed is:

1. A hearing aid system, comprising:

a first input transducer for converting an acoustical signal to a first electrical input signal comprising a direct or external part and an acoustical feedback part;

an output transducer for generating an acoustical signal from an electrical output signal;

an electrical signal path between the input transducer and the output transducer and comprising a signal processing unit including an amplifier part for enabling frequency dependent gain of an input signal, the amplifier part being on an input side of the signal path between the input transducer and the amplifier part and an output side of the signal path between the amplifier part and the output transducer;

an electrical feedback cancellation path between the output side and the input side of the signal path for compensating acoustic feedback between the output transducer and the input transducer by subtracting from a signal on the input side of the amplifier part, the electrical feedback cancellation path comprising an adaptive filter for providing a variable filtering function providing an estimate of the acoustical feedback;

a probe signal generator for generating a probe signal for use in characterizing an acoustical feedback path, the probe signal being fed to the adaptive filter of the electrical feedback cancellation path; and a feedback enhancer unit, providing an output signal for improving the estimate of the feedback cancellation path made by the adaptive filter, the hearing aid system being further adapted to provide a second electrical input signal from which the direct or external part of said first electrical input signal can be estimated, said second electrical input signal being connected to the feedback enhancer unit, wherein the feedback enhancer unit is configured to estimate the part of the first input transducer signal that does not originate from the probe signal from said second electrical input signal, which is substantially free from the probe signal, said estimate being subtracted from the first input transducer signal to provide the output of the feedback enhancer unit.

2. A hearing aid system according to claim 1, wherein the adaptive filter of the electrical feedback cancellation path comprises a variable filter part for providing a frequency dependent filtering function and a control part for controlling the characteristics of the frequency dependent filtering function.

3. A hearing aid system according to claim 1, further comprising:

a second input transducer for converting an acoustical signal to said second electrical input signal, the second input transducer being located at a position where the acoustical signal is substantially free from acoustic feedback from said output transducer.

4. A hearing aid system according to claim 1, wherein the feedback enhancer unit comprises a second adaptive filter, in addition to the adaptive filter of the feedback cancellation path, for estimating the first electrical input signal of the first input transducer by means of the second electrical input signal from the second input transducer of the hearing aid system.

5. A hearing aid system, comprising:

a first input transducer for converting an acoustical signal to a first electrical input signal comprising a direct or external part and an acoustical feedback part;

an output transducer for generating an acoustical signal from an electrical output signal;

an electrical signal path between the input transducer and the output transducer and comprising a signal processing unit including an amplifier part for enabling frequency dependent gain of an input signal, the amplifier part being on an input side of the signal path between the input transducer and the amplifier part and an output side of the signal path between the amplifier part and the output transducer;

an electrical feedback cancellation path between the output side and the input side of the signal path for compensating acoustic feedback between the output transducer and the input transducer by subtracting from a signal on the input side of the amplifier part, the electrical feedback cancellation path comprising a first adaptive filter for providing a variable filtering function providing an estimate of the acoustical feedback;

a probe signal generator for generating a probe signal for use in characterizing an acoustical feedback path, the probe signal being fed to the first adaptive filter of the electrical feedback cancellation path; and a feedback enhancer unit, providing an output signal for improving the estimate of the feedback cancellation path made by the first adaptive filter, the hearing aid system being further adapted to provide a second electrical input signal from which the direct or external part of said first electrical input signal can be estimated, said second electrical input signal being connected to the feedback enhancer unit, wherein the feedback enhancer unit comprises a second adaptive filter, in addition to the first adaptive filter of the feedback cancellation path, for estimating the direct or external part of the first electrical input signal of the first input transducer by means of the second electrical input signal from the second input transducer of the hearing aid system, the output of the second adaptive filter constituting an estimate of the direct or external part of the first electrical input signal, and the feedback enhancer unit is configured to minimize its output by controlling the second adaptive filter, and thereby enhancing the signal that originates from the probe noise part of the output of the hearing aid.

6. A hearing aid system according to claim 1, further comprising:

an adaptive shadow system configured to minimize error between the output from the adaptive filter of the feedback path and the output from the feedback enhancer and thereby estimating the feedback path, wherein the adaptive filter is the filter, which performs the feedback cancellation, by using the estimate of the feedback path, from the adaptive shadow system.

7. A hearing aid system according to claim 3, wherein said second electrical signal of the second input transducer is filtered in said feedback enhancer unit and subtracted from the feedback corrected input signal and fed to the control part of the adaptive filter of the feedback cancellation path and used to adapt the filtering function of the adaptive filter.

8. A hearing aid system according to claim 3, wherein said second input transducer is an input transducer located further apart from the output transceiver than the first transducer but being part of a same hearing aid as the first transducer.

9. A hearing aid system according to claim 3, wherein said second input transducer is a microphone of some other apparatus with which the hearing aid can communicate.

10. A hearing aid system according to claim 3, wherein said second input transducer is a microphone of another hearing aid of a binaural fitting.

11. A hearing aid system according to claim 3, wherein said second input transducer is a microphone of a mobile telephone or some other communications device being able to communicate, by wire or wirelessly, with the hearing aid.

12. A hearing aid system according to claim 9, configured to provide that the other apparatus comprising the second input transducer can communicate with the hearing aid via a wireless communications standard.

* * * * *